US005221368A

United States Patent [19]

Gabriel et al.

[11] Patent Number: 5,221,368

[45] Date of Patent: Jun. 22, 1993

[54] METHOD OF OBTAINING A MAGNETIC MATERIAL OF THE RARE EARTH/TRANSITION METALS/BORON TYPE IN DIVIDED FORM FOR CORROSION-RESISTANT MAGNETS

[75] Inventors: Armand Gabriel, Grenoble, France; Masato Sagawa, Kyoto, Japan; Philippe Tenaud, Crolles, France; Pierre Turillon, Ramsey, N.J.; Fernand Vial, Meylan, France

[73] Assignee: Aimants Ugimag, Saint-Pierre D'Allevard, France

[21] Appl. No.: 735,893

[22] Filed: Jul. 25, 1991

[30] Foreign Application Priority Data

Jul. 25, 1990 [FR] France ..... 90 09722

[51] Int. Cl.[5] ..... H01F 1/02

[52] U.S. Cl. ..... 148/101; 148/105; 148/122

[56] References Cited

U.S. PATENT DOCUMENTS

| | | | |
|---|---|---|---|
| 4,853,045 | 8/1989 | Rozendaal | 148/103 |
| 5,091,020 | 2/1992 | Kim | 148/101 |
| 5,110,374 | 5/1992 | Takeshita et al. | 148/101 |

FOREIGN PATENT DOCUMENTS

| | | | |
|---|---|---|---|
| 1-99201 | 4/1989 | Japan | 148/101 |

*Primary Examiner*—John P. Sheehan

*Attorney, Agent, or Firm*—Dennison, Meserole, Pollack & Scheiner

[57] ABSTRACT

The invention relates to a method of obtaining friable and relatively inert TR Fe B type magnetic materials in divided form which lead to magnets having improved corrosion resistance. This method involves treating the material in an atmosphere containing (or capable of containing) hydrogen under the following conditions of absolute pressure (P) and of temperature (T° C.): if $P \leqq Pa$, $250 < T < 550$; and if $P > Pa$, $250 + 100 \log (P/Pa) < T < 250 + 100 \log (P/Pa)$ log base 10, Pa being atmospheric pressure. The invention is used for obtaining sintered TR Fe B magnets having improved corrosion resistance.

10 Claims, No Drawings

METHOD OF OBTAINING A MAGNETIC MATERIAL OF THE RARE EARTH/TRANSITION METALS/BORON TYPE IN DIVIDED FORM FOR CORROSION-RESISTANT MAGNETS

The invention relates to a method of obtaining rare earth (RE) Fe B type magnetic materials in divided form which are friable and relatively inert toward air and lead to magnets having improved corrosion resistance.

The term RE Fe B type magnetic materials covers materials essentially consisting of a T1 tetragonal magnetic phase similar to $RE_2 Fe_{14} B$, wherein RE designates one (or more) rare earth(s), including yttrium, wherein the iron and the boron can be partially substituted, as known, by other elements such as cobalt with or without addition of metals such as aluminium, copper, gallium etc. or refractory metals. See EP-A-101552, EP-A-106558, EP-A-344542 and French patent applications nos. 89-16731 and 89-16732.

The rare earth preferably consists mainly of neodymium which can be partially substituted by praseodymium and dysprosium.

The magnets in this family, in particular sintered magnets, nowadays have the most high-powered magnetic properties, in particular with regard to residual induction (Br), intrinsic coercivity ($H_{cJ}$) and specific energy [$(BH)_{max}$].

However, the materials constituting these magnets have a disadvantage which is their high sensitivity to corrosion, particularly in a damp atmosphere, in both the bulk and divided state. The iron has been partially substituted by cobalt to reduce this sensitivity, but this yielded inadequate results.

The conventional method of producing magnets of this type involves obtaining a fine powder, possibly compressing it in a magnetic field and sintering it prior to various finishing treatments and final magnetisation.

The powders are generally obtained in two ways:

preparation by melting of the alloy which is firstly ground (lumps of approximately a few cm3), precrushed to a size of about 5/10 mm (mechanically or by hydrogen crackling) and finally crushed in a jet mill or by attrition in a moist medium to a size smaller than 50 μm and preferably 20 μm.

reduction by calcium of the oxides in the presence of metallic powders, the maximum size of the granules formed by the particles of alloy thus obtained being approximately 300 μm, the other stages of the process remaining the same.

The term hydrogen crackling refers to a process for dividing an alloy involving subjecting a lump-form alloy to a hydrogen atmosphere under temperature and pressure conditions which depend on the alloy and allow at least partial conversion into a hydride, then subjecting it to different temperature and pressure conditions such that the hydride decomposes. This cycle frequently leads to noisy fragmentation of the alloy which is called "decrepitation". The principle thereof is described fairly generally in GB 1 313 272 and GB 1 554 384 for binary combinations of a rare earth and a transition metal, mainly cobalt, this process not having produced major advantages over conventional crushing methods and not therefore having received significant industrial application for these combinations. The same method has been applied in FR 2 566 758 for obtaining fine reactive powders by passing through new $RE_2 Fe_{14} BH_y$ hydrides by formation of hydrides, preferably at ambient temperature and under a hydrogen pressure at least equal to 20 bars, then by partial dehydridation by heating them above 150° C. at ambient pressure or by total dehydridation by heating them to at least 400° C. under low vacuum.

This method has then been dealt with in EP A-0280372, where an inert gas such as argon or nitrogen is added to the hydrogen to reduce the risks of explosion. Although the dehydridation conditions are described therein as in FR 2 566 758 (beginning of dehydridation of $Nd_2 Fe_{14} BH_y$ at about 150° to 260° C., the remainder of the hydrogen issuing at about 350 to 650° C.), the conditions for formation of hydrides are vaguer, involving a restriction to below 300° C. to avoid a risk of disproportionation of the alloy with the formation of finely divided iron. In French application, the powder is formed into a permanent magnet while untreated, by compression, when it is in the hydrided state because it is said to be less reactive toward the oxygen in dry air. Dehydridation is carried out in the sintering furnace, so large quantities of gas have to be discharged by sustained pumping when industrial charges are used.

Although the crushing, compression and sintering operations can be carried out in a protective atmosphere, the powders oxidize in part during their transformations prior to densification (sintering) by reaction with the residual O2 and/or H2O contents of said atmospheres. This oxidation is particularly pronounced when the developed surface area of the material is large, for example in the precrushing, crushing, storage and powder compression stages and during the rise in the sintering temperature. As the Applicants have themselves found, these disadvantages are not overcome by the hydrogen crackling method in the art described above.

This oxidation, which essentially affects the rare earth or earths (RE) contained in the material, is accompanied by the following disadvantages:

this reaction consumes the RE, thus reducing the fraction of intermetallic phase which is rich in active TR.

the presence of oxides (or hydroxides) leads to difficulties during sintering (less densification)

it reduces the magnetic properties of the final magnet, in particular the residual magnetism Br, the specific energy $(BH)_{max}$ and can considerably increase its sensitivity to atmospheric corrosion.

it increases the cost of the finished product: need to increase the initial RE content of the alloy and to use complex protected equipment.

For all these reasons, the Applicants have sought a method which will considerably reduce the reactivity of these materials toward atmospheres, in particular those containing oxygen and/or steam, and will lead to increased corrosion-resistance in the sintered magnets.

They have found that conditions other than those formerly described allowed the preparation, by hydrogen treatment, of friable materials which could be used after crushing for the production of permanent magnets which are relatively passive toward atmospheric air at ambient temperature, therefore easier to handle during the various stages of the process, and require only reduced degasification treatments in the sintering furnace and, in particular, lead to magnets which are particularly resistant to corrosion.

The process according to the invention involves treating the material (ground ingot or granulates issuing from reduction of oxides) in a reactor where the hydrogen is introduced under the particular conditions defined below of temperature (T) and pressure (P), at least in a final phase.

"Pa" designates normal atmospheric pressure (≃1 bar, that is 0.1 MPa).

If P=<Pa, 250<T° C.<550 should apply

If P>Pa, 250+100 log (P/Pa)<T° 1 C.<550+100 log (P/Pa); (log base 10) should apply.

In a preferential manner and to improve control of the reaction kinetics, the temperature T is selected between 350° C. and 550° C. and, in particular, between 350° and 500° C. if P<Pa and the conditions 350+100 log(P/Pa)<T<550+log (P/Pa) and in particular 350+100 log (P/Pa<T<500+100 log (P/Pa) if P>Pa.

Again in a preferred manner, the temperature is kept above 400° C.

It has in fact curiously been found that the higher the starting temperature, weaker the exothermicity of the reaction, and this constitutes a safety factor with regard to use and the longevity of the apparatus.

Furthermore, for the reaction kinetics to suffice, it is preferable to work with a pressure P which is higher than or equal to 0.5 atmosphere; moreover, with regard to safety and to the simplicity of construction of the treatment chamber, in particular with regard to its impermeability, it is preferable to work under less than 1 atmosphere.

The term hydrogen pressure P denotes its absolute pressure in the case of a gas atmosphere only or its partial pressure in the case of a mixture of gases containing hydrogen or a body providing nascent hydrogen such as ammonia $NH_3$. The term temperature T at which $H_2$ is introduced means the minimum temperature to which the product is brought by a source of heat, independently of the heating possibly resulting from the exothermic hydride-forming reaction; the actual temperature of the material is that attained by the material during its transformation. The duration of treatment depends on the operating conditions employed; it is considered that the reaction is completed when the hydrogen pressure and the temperature have become constant.

The reactor containing the product is then brought to the usual temperature, pressure and atmosphere conditions.

It is worthy of note that under conditions external to the range claimed above, the hydrogen treatment leads to materials which are extremely sensitive to oxidation, as demonstrated by certain examples which are given below.

It is possible that the higher sensitivity of the powders prepared by the methods already described in the prior art of hydrogen crackling is linked to the effective formation of the stable hydride combined with the magnetic phase $RE_2Fe_{14}BH_y$ ($0<y<5$), of which the subsequent decomposition should generate many sites which are active toward the environment.

Under certain temperature and pressure conditions, this decomposition can also lead to the destruction of the magnetic phase $RE_2Fe_{14}B$ (disproportionation) with formation of finely divided α - Fe, $Fe_2B$, $RE_2Fe_{17}$ and TR. The Applicants have found that, under the conditions which they have investigated, this disproportionation does not occur and they attribute it to the absence of formation of the stable hydride of the magnetic phase which would absorb and transmit the hydrogen by mere solid diffusion without creation or with weak creation of active sites.

It is known that the hydrides of rare earths are not strict defined compounds but that the stoichiometry thereof can vary within wide proportions. Thus, it is known that these hydrides of formula RE $H_x$ have a value x which can vary continuously from 1.8 to 3.

Continuing their research, the Applicants have however found that during hydride formation according to the invention, a TR hydride of formula RE $H_x$, with x between 1.8 and 2.45—designated here by "$REH_2$"—is essentially formed to the exclusion of all others; in particular, the formation of a hydride of $RE_2Fe_{14}B$ Hy type formula or of α -Fe or of a more highly hydrogenated hydride such as $NdH_3$ has not been detected under the conditions of the invention. The material issuing from the hydrogen treatment consists essentially of three main phases: $RE_2Fe_{14}B$, known as T1, "RE $H_2$", and a boron-rich phase already described in the prior art. The appearance of appreciable friability of the stable and passive hydrogenated products is attributed to the formation of this hydride which is rich in rare earth, without creation of the hydrided phase of T1. However, this friability does not constitute a disadvantage for the well-being of the compact during the rise in temperature toward sintering because this phase is in the minority in volume vis-a-vis $T_1$.

On the contrary, outside the disclosed range, the Applicants have found that the hydrogen treatment also leads to materials which are friable but contain large quantities of T1 hydride, $NdH_3$ hydride or α - Fe. These materials did not allow highly corrosion resistant magnets to be obtained, see the examples outside the invention.

The invention will be understood better by means of the following examples:

Tests have been carried out on materials obtained by melting, having the following composition (in at %) which is non-limiting and has a small content of RE in order to obtain the highest residual magnetism. They allowed the passivity of the materials obtained under various conditions according to the invention and outside the invention and the corrosion resistance quality of the final magnets to be tested. The process described in this invention has been successfully applied to other compositions with TR or with B or containing the substitutions and/or additions described in the prior art (see EP-A-101552, EP-A-106558, EP-A-344542), or again to granulates originating from the so-called diffusion reduction process.

| | Nd | Dy | B | Al | Fe |
|---|---|---|---|---|---|
| C1 | 13.5 | 1.5 | 8 | 0.75 | remainder |

The friability was measured by the grain size spectrum (% by weight passing through the sieve without external stress) of the material obtained after the hydride-forming treatment.

The nature of the phases present in the material subjected to hydride formation was determined by X-ray diffraction.

The magnetic characteristics—$B_r$ and $H_{cJ}$—were determined on the sintered magnets prepared by the process recalled in the introduction and without extreme precautions for the handling atmospheres.

The oxygen content of the magnets obtained lies, as a function of their composition, in the range which is most desirable for the particular use thereof. It is known that the prior art recommends either relatively high oxygen contents in order to improve the corrosion resistance, as is the case in U.S. Pat. No. 4,588,439; or, on the other hand, very low contents, as in the patent EP 0.197.712, if high magnetic properties (Br, (BH)max) are to be obtained.

The corrosion resistance of the sintered magnets has been estimated by their life in an autoclave at 115° C. under 0.175 MPa at 100% relative humidity. In all cases, the magnets were coated before testing under identical conditions by an epoxy resin after a surface preparation (phosphatation). The content of the coating has been estimated by visual examination (blisters) and by the cross-cutting test.

The results are compiled in Tables 1 to 8 (as follows).

Examples 1, 6 and 7 relate to the prior art or to conditions outside the invention, the other tests (Examples 2 to 5 and 8) relate to the invention.

EXAMPLE 1

Formation of hydrides at 25° C. under P = 0.1 MPa of $H_2$ (outside invention)

| Composition | C1 |
|---|---|
| Grain size | % (by weight) |
| 0-100 μm | 1.6 |
| 100-500 μm | 8.5 |
| 500-1000 μm | 89.9 |
| 1000 and greater | 0 |
| Main phases present | (NdDy)2 Fe14 BH3<br>(NdDy) H3<br>Nd Fe4 B4 |
| Density (g/cm3) | 7.4 |
| Residual magnetism (T) | 1.14 |
| Coercivity (kA/m) | 1480 |
| Life in autoclave (days) | 4 |

EXAMPLE 2

Formation of hydrides at 300° C. under P = 0.1 MPa of $H_2$ (invention)

| Composition | C1 |
|---|---|
| Grain size | % (by weight) |
| 0-100 μm | 1.0 |
| 100-500 μm | 11.3 |
| 500-1000 μm | 87.7 |
| 1000 and greater | 0 |
| Main phases present | (Nd,Dy)2 Fe14 B<br>"(Nd,Dy) H2"<br>Nd Fe4 B4 |
| Density (g/cm3) | 7.5 |
| Residual magnetism (T) | 1.16 |
| Coercivity (kA/m) | 1616 |
| Life in autoclave (days) | 9 |

EXAMPLE 3

Formation of hydrides at 400° C. under P = 0.1 MPa of $H_2$ (invention)

| Composition | C1 |
|---|---|
| Grain size | % (by weight) |
| 0-100 μm | 1.2 |
| 100-500 μm | 11.1 |
| 500-1000 μm | 87.7 |
| 1000 and greater | 0 |
| Main phases present | (Nd,Dy)2 Fe14 B<br>"(Nd,Dy) H2"<br>Nd Fe4 B4 |
| Density (g/cm3) | 7.5 |
| Residual magnetism (T) | 1.16 |
| Coercivity (kA/m) | 1608 |
| Life in autoclave (days) | 8 |

EXAMPLE 4

Formation of hydrides at 400° C. under P = 0.01 MPa of $H_2$ (invention)

| Composition | C1 |
|---|---|
| Grain size | % (by weight) |
| 0-100 μm | 1.0 |
| 100-500 μm | 12.2 |
| 500-1000 μm | 86.8 |
| 1000 and greater | 0 |
| Main phases present | (Nd,Dy)2 Fe14 B<br>"(Nd,Dy) H2"<br>Nd Fe4 B4 |
| Density (g/cm3) | 7.5 |
| Residual magnetism (T) | 1.16 |
| Coercivity (kA/m) | 1600 |
| Life in autoclave (days) | 9 |

EXAMPLE 5

Formation of hydrides at 400° C. under P = 0.001 MPa of $H_2$ (invention)

| Composition | C1 |
|---|---|
| Grain size | % (by weight) |
| 0-100 μm | 0.8 |
| 100-500 μm | 9.1 |
| 500-1000 μm | 90.1 |
| 1000 and greater | 0 |
| Main phases present | (Nd,Dy)2 Fe14 B<br>"(Nd,Dy) H2"<br>Nd Fe4 B4 |
| Density (g/cm3) | 7.5 |
| Residual magnetism (T) | 1.16 |
| Coercivity (kA/m) | 1600 |
| Life in autoclave (days) | 8 |

EXAMPLE 6

Formation of hydrides at 550° C. under P = 0.1 MPa of $H_2$ (outside invention)

| Composition | C1 |
|---|---|
| Grain size | % (by weight) |
| 0-100 μm | 0 |
| 100-500 μm | 0 |
| 500-1000 μm | 30.2 |
| 1000 and greater | 69.8 |
| Main phases present | (Nd,Dy)2 Fe14 B<br>"(Nd,Dy) H2"<br>Nd Fe4 B4 |
| Density (g/cm3) | 7.1 |
| Residual magnetism (T) | 0.82 |
| Coercivity (kA/m) | 320 |
| Life in autoclave (days) | 1 |

EXAMPLE 7

| Formation of hydrides at 250° C. under P = 100 bar (10MPa) of $H_2$ (outside invention) | |
|---|---|
| Composition | C1 |
| Grain size | % (by weight) |
| 0 < % < 100 μm | 1.2 |
| 100 < % < 500 μm | 10.0 |
| 500 < % < 1000 μm | 88.8 |
| 1000 < % | 0 |
| Main phases present | (Nd,Dy)2 Fe14 BH3<br>(Nd,Dy) H2.9<br>Nd Fe4 B4 |
| Density (g/cm3) | 7.3 |
| Residual magnetism (T) | 1.13 |
| Coercivity (kA/m) | 1380 |
| Life in autoclave (days) | 4 |

EXAMPLE 8

| Formation of hydrides at 700° C. under P = 100 bar (10MPa) of $H_2$ (invention) | |
|---|---|
| Composition | C1 |
| Grain size | % (by weight) |
| 0 < % < 100 μm | 2.2 |
| 100 < % < 500 μm | 12.3 |
| 500 < % < 1000 μm | 85.5 |
| 1000 < % | 0 |
| Main phases present | (Nd,Dy)2 Fe14 B<br>"(Nd,Dy) H2"<br>Nd Fe4 B4 |
| Density (g/cm3) | 7.5 |
| Residual magnetism (T) | 1.16 |
| Coercivity (kA/m) | 1650 |
| Life in autoclave (days) | 9 |

Example 1 shows that under conditions close to those of the prior art (25° C. at about 0.1 MPa of $H_2$) and for the exemplified composition, a duration of 4 days is the maximum which the coated magnet can withstand in the autoclave before blistering which is a sign of corrosion.

Example 2 shows that hydride formation at 300° C. under conditions which are representative of the invention leads to a life in an autoclave which is considerably increased (+100%) over Example 1, which is perhaps linked to improved compactness.

A similar result is obtained by hydride formation at 400° C. under 0.1 MPa of $H_2$ (Example 3), under 0.01 MPa of $H_2$ (Example 4), or under $10^{-3}$ MPa of $H_2$ (Example 5).

Example 6 shows that at 550° C. there is no more embrittlement. Mechanical precrushing is therefore necessary. Densification becomes difficult; the lives in an autoclave are extremely reduced as well as the magnetic properties, undoubtedly owing to the presence of numerous open pores.

At 250° C. under 100 bar (10 MPa)—Example 7—and identically to Example 1, easy corrosion is found.

At 700° C. (Example 8), the magnetic properties as well as the corrosion resistance are at an optimum, similar to those in Example 2.

Apart from the high passivity of the materials obtained and the improved corrosion resistance of the magnets prepared with them, the process according to the invention provides the following economic and technical advantages:

less consumption of $H_2$ since the phase which is rich in rare earth and occupies several per cent of the structure is hydrided at its lowest level slight desorption of the $H_2$ during sintering which prevents the appearance of defects such as blow holes or cracks and allows parts having a large unit volume to be obtained facility of crushing of the passivated materials absence of formation of a ferromagnetic phase Fe α owing to the disproportionation reaction described in the prior art lower consumption of RE safety improved by the reduced volume of $H_2$ to be used.

We claim:

1. Method of obtaining a friable and relatively inert magnetic material comprising iron, a rare earth element and boron in divided form for the manufacture of highly corrosion resistant permanent magnets, comprising treating an alloy comprising iron, a rare earth element and boron in a reactor under an atmosphere comprising hydrogen and under the conditions of hydrogen pressure P and temperature T:

if $P \leqq Pa$, 250° C.$<T<$550° C. applies; and if $P>Pa$, $250+100 \log_{10}(P/Pa)$ °C.$<T<550+100 \log_{10}(P/Pa)$ °C. applies;

wherein Pa is atmospheric pressure;

said treating being carried out until P and T become substantially constant; and returning the reactor containing the treated alloy to ambient temperature, pressure and atmospheric conditions.

2. Method according to claim 1, wherein:

if $P \leqq Pa$, $T<500$° C. applies; and if $P>Pa$, $T<500+100 \log_{10}(P/Pa)$ °C. applies.

3. Method according to claim 1, where:

if $P \leqq Pa$, $350<T<550$° C. applies; and if $P>Pa$, $350+100 \log (P/Pa)<T<550+100 \log (P/Pa)$.

4. Method according to claim 1 wherein:

if $P \leqq Pa$, $350<T<500$° C. applies; and if $P>Pa350+100 \log (P/Pa)<T<500+100 \log (P/Pa)$ applies.

5. Method according to one of claims 1, 3 or 4, wherein the temperature is >400° C.

6. Method according to one of claims 1, 3 or 4, wherein the pressure P is higher than 0.5 atmosphere.

7. Method according to claim 6, wherein the pressure P is lower than 1 atmosphere.

8. Method according to claim 3 wherein:

if $P \leqq Pa$, $350<T<500$° C. applies; and if $P>Pa$, $350+100 \log (P/Pa)<T<500+100 \log (P/Pa)$ applies.

9. Method according to claim 5 wherein the pressure P is higher than 0.5 atmosphere.

10. Method according to claim 9 wherein the pressure P is lower than 1 atmosphere.

* * * * *